US005847701A

United States Patent [19]

Eglit

[11] Patent Number: 5,847,701

[45] Date of Patent: Dec. 8, 1998

[54] METHOD AND APPARATUS IMPLEMENTED IN A COMPUTER SYSTEM FOR DETERMINING THE FREQUENCY USED BY A GRAPHICS SOURCE FOR GENERATING AN ANALOG DISPLAY SIGNAL

[75] Inventor: Alexander Julian Eglit, Half Moon Bay, Calif.

[73] Assignee: Paradise Electronics, Inc., San Jose, Calif.

[21] Appl. No.: 872,774

[22] Filed: Jun. 10, 1997

[51] Int. Cl.[6] ..... G09G 5/00

[52] U.S. Cl. ..... 345/204; 345/213

[58] Field of Search ..... 345/132, 156, 345/204, 213; 348/177, 178, 179, 180, 181, 182, 183, 184, 185, 186, 189, 190, 191

[56] References Cited

U.S. PATENT DOCUMENTS

| | | | |
|---|---|---|---|
| Re. 33,916 | 5/1992 | Saenz et al. | 340/703 |
| 4,086,579 | 4/1978 | Easter | 340/324 |
| 4,230,974 | 10/1980 | Haak | 315/399 |
| 4,707,638 | 11/1987 | Hara et al. | 315/169.3 |
| 4,991,023 | 2/1991 | Nicols | 358/242 |
| 5,031,118 | 7/1991 | Morizot | 364/521 |
| 5,216,412 | 6/1993 | Gawell et al. | 340/720 |
| 5,241,281 | 8/1993 | Wilkes et al. | 340/799 |
| 5,285,197 | 2/1994 | Schmidt et al. | 345/213 |
| 5,302,950 | 4/1994 | Johnson et al. | 341/123 |
| 5,404,153 | 4/1995 | Kim | 345/213 |
| 5,438,341 | 8/1995 | Kobayashi et al. | 345/20 |
| 5,457,473 | 10/1995 | Arai et al. | 345/10 |
| 5,483,260 | 1/1996 | Parks et al. | 345/156 |
| 5,548,307 | 8/1996 | Onagawa | 345/213 |
| 5,550,556 | 8/1996 | Wu et al. | 345/14 |
| 5,565,897 | 10/1996 | Kikinis | 345/213 |
| 5,579,029 | 11/1996 | Arai et al. | 345/132 |
| 5,602,567 | 2/1997 | Kanno | 345/132 |

FOREIGN PATENT DOCUMENTS

| | | | |
|---|---|---|---|
| 4-269796 | 9/1992 | Japan . | |
| 5-35240 | 2/1993 | Japan . | |
| 8-160928 | 8/1996 | Japan . | |
| 8-202330 | 8/1996 | Japan . | |
| WO 93/0658 | 4/1993 | WIPO | G09G 5/00 |

*Primary Examiner*—Richard A. Hjerpe
*Assistant Examiner*—Ronald Laneau
*Attorney, Agent, or Firm*—Law Firm of Naren Thappeta

[57] ABSTRACT

A display unit which can determine the frequency (original frequency) used by a graphics source for generating an analog signal. A sequence of test patterns are generated according to a predetermined convention. The sequence of test patterns are encoded in an analog display signal in a graphics source and transmitted to a digital display unit. The digital display unit samples the analog display signal to generate a sequence of sampled values. The digital display unit determines whether the sampled values equal one of the sequence of test patterns based on the predetermined convention. The digital display unit varies (changes) the sampling frequency until the sampled values equal one of the sequence of test patterns. The sampling frequency equals the original frequency when the sampled values equal the sequence of test patterns. In one embodiment, zeros and ones are used in alternate positions of each horizontal line. The absence of runs in the sampled values indicates that the sampling frequency equals the original frequency.

31 Claims, 10 Drawing Sheets

METHOD AND APPARATUS IMPLEMENTED IN A COMPUTER SYSTEM FOR DETERMINING THE FREQUENCY USED BY A GRAPHICS SOURCE FOR GENERATING AN ANALOG DISPLAY SIGNAL

RELATED APPLICATIONS

The present application is related to the following co-pending Patent Applications, which are both incorporated in their entirety into the present application herewith:

1. Patent Application entitled, "A Method and Apparatus for Upscaling an Image", Filed Feb. 24, 1997, having Ser. No. 08/804,623 and Attorney Docket Number: PRDN-0001;

2. Patent Application entitled, "A Method and Apparatus for Clock Recovery in a Digital Display Unit", Filed Feb. 24, 1997, having Ser. No. 08/803,824 and Attorney Docket Number: PRDN-0002; and 3. Patent Application entitled, "A Method and Apparatus for Automatically Determining Signal Parameters of an Analog Display Signal Received by a Display Unit of a Computer System", Ser. No. : UNASSIGNED, Filed Concurrently herewith, and having Attorney Docket Number: PRDS-0003.

BACKGROUND OF THE INVENTION

1. Field of the Invention

The present invention relates to computer graphics systems, and more specifically to a method and apparatus implemented in a digital display unit of a computer system for determining the frequency used by a graphics source for generating an analog display signal.

2. Related Art

Digital display units are often used in computer systems to display images. Typically, an image is sent to a digital display unit encoded in the form of an analog signal (e.g., RGB signals) and the display unit reproduces the image represented by the analog signal. Digital display units are characterized by discrete points (referred to as "pixels") on a display screen, and these points are typically activated individually based on the received analog signal. An image is produced as a result of such collective actuation of the pixels.

For a proper reproduction of the image, it may be necessary to determine the signal parameters of the analog signal. In general, signal parameters are the values which enable a display unit to reproduce an image represented by an analog display signal. Several example display signal parameters and approaches for determining them are described in co-pending patent application entitled, "A Method and Apparatus for Automatically Determining Signal Parameters of an Analog Display Signal Received by a Display Unit of a Computer System", Ser. No. : UNASSIGNED, Filed Concurrently herewith, and having Attorney Docket Number: PRDS-0003, which is incorporated in its entirety herewith.

One of the display signal parameters which facilitates accurate reproduction of an image encoded in an analog display signal is the frequency used by a graphics source for generating the analog display signal. The significance of this parameter will be explained below with reference to FIGS. 1A and 1B.

FIG. 1A includes DAC (digital to analog converter) 110 and ADC (analog to digital converter) 120 connected by an analog link 112. DAC 110 is usually included in a graphics source and ADC 120 is included in a display unit. A typical graphics source represents an images as digital pixel data elements and converts the pixel data elements to analog signal as is well known in the art. In general, DAC 110 receives clock 111 having a frequency (original frequency) of $F_{org}$ and converts each pixel data element to analog signal during a clock cycle of clock 111. The analog signal so generated is transferred to ADC 120 over analog ling 112.

FIG. 1B is a diagram representing the generated analog signal generated by DAC 110. Signal 150 is shown in reference to $F_{org}$ provided to DAC 110. Signal 150 includes several settled areas 152 and unsettled areas 151. An unsettled area 151 corresponds to a transient period during which signal 150 reaches a steady state. A steady state is said to be reached when an analog signal portion acquires a signal level close to the final signal level and remains within a narrow range (typically within 5–10% of the final signal level) of the final signal level. The settled area corresponds to the period after analog signal 150 has reached a steady state.

ADC 120 samples analog signal 150 to generate pixel data elements. Individual pixel on a display screen are actuated based on these pixel data elements to generate an image. For an accurate reproduction of an image encoded in signal 150, it may be desirable that ADC 120 sample analog signal 150 with a clock frequency equal to $F_{org}$. That is, the sampling frequency $F_s$ provided on clock 121 should equal $F_{org}$ in the ideal case.

The effect of sampling when sampling frequency $F_s$ equals $F_{org}$ is illustrated by sampling points 161–166 shown in FIG. 1B. As can be appreciated, in such a case, analog signal 150 can be consistently sampled in the settled areas 152. Due to such sampling in the settled areas, the sampled values will closely represent the image encoded in analog signal 150.

In addition, consistent sampling around the middle of the settled areas generally results in a sampling scheme which has low sensitivity to clock jitter commonly encountered in clock 121 having a frequency $F_s$ provided to ADC 120. That is, due to clock jitter, sampling may occur at a point close to (as opposed to exactly at) each of 161–166. As the analog display signal 150 generally has approximately equal signal level throughout the settled area, sampling anywhere in the settled area may provide the same sampled value. As a result, the resulting sampled values are not affected by clock jitter.

Some of the undesirable results which may result if sampling frequency $F_s$ is not equal to $F_{org}$ are illustrated with reference to sampling points 171–177. Sampling points 171–177 correspond to a sampling frequency $F_s$ having a frequency greater than $F_{org}$. As can be readily appreciated, some of the samples will be taken in unsettled areas 151. As a result, the errors can be fairly large as can be seen with reference to point 174.

Thus, if sampling frequency $F_s$ is not equal to $F_{org}$, some samples will be taken during unsettled areas 151, and errors will result. These errors generally create undesirable visible artifacts in displays. For example, if an image represented by analog signal 130 has sharp transitions (e.g., from black to white), the errors will cause intermediate colors to be displayed. The intensity of these colors can vary due to jitter in the sampling clock. These artifacts can be unpleasant for a human eye.

Therefore, it is desirable to sample analog signal 130 with a sampling frequency $F_s$ which is equal to $F_{org}$. Unfortunately, in some graphics environments (e.g., SVGA), the clock signal $F_{org}$ is not provided to graphic units which include ADC 120.

Accordingly, what is needed is a method and apparatus which enables a display unit to determine the original frequency ($F_{org}$) so that a received analog display signal can be sampled at the original frequency.

SUMMARY OF THE INVENTION

The present invention is described in the context of a digital display unit and a graphics source implemented in a computer system. In accordance with the present invention, the graphics source generates a sequence of test patterns comprising a plurality of pixel data elements according to a predetermined convention. The pixel data elements define the display of pixels (positions) of several horizontal lines. The graphics source converts the pixel data elements into an analog display signal at an original frequency and sends the analog signal to a digital display unit. The digital display unit samples the analog signal at a sampling frequency to generate a plurality of sampled values. The digital display unit determines whether the sampled values equal a test pattern according to the predetermined convention. If the sampled values are equal to the test pattern, the sampling frequency equals the original frequency. Thus, the digital display unit varies the sampling frequency until the sampled values (of a portion of the analog signal corresponding to a test pattern according to the predetermined convention) for a test pattern equal a test pattern.

One of several conventions can be used in generating the test patterns. A test pattern may include a predetermined fixed pattern (e.g., zeros and ones in alternate positions of a horizontal lines) or an arbitrary sequence of bits. If a test pattern includes an arbitrary sequence of bits, techniques such as cyclic redundancy check (CRC) schemes may be employed to determine whether the sampled values equal the test pattern encoded in the analog display signal. In addition, each test pattern can be a part of a frame or can span multiple frames. The test patterns simply need to conform to a predetermined convention.

Thus, according to one example predetermined convention, a test pattern includes black and white colors in alternate positions (pixels) of several horizontal lines. The display unit samples each horizontal line at a sampling frequency, and examines the sampled values for any runs. A run refers to the repetition of the same sampled value in a horizontal line. The sampling frequency is varied until the total number of runs for a horizontal line equals zero. When the total number of runs for a horizontal line equals zero, the sampling frequency equals the original frequency. To enable the digital display unit to vary the sampling frequency until a match is detected, the graphics source sends several frames of test patterns consecutively.

In the above described convention, an analog signal can contain either a test pattern or display data. Display data generally represents an image. To distinguish between the two cases, an indication is sent to the digital display unit indicating the presence of a test pattern in the analog display signal. In one embodiment, a cyclic redundancy check (CRC) based scheme is used to provide that indication. The test data (with alternate zeros and ones) follows such an indication. The indication can also be manual. For example, a user can press a button on a display unit to indicate that the test pattern is being received in parallel.

According to another example predetermined convention, a test pattern can include any arbitrary sequence of bits. The test pattern is encoded in an analog display signal with each bit of the test pattern being encoded as a pixel. Each pixel can have a value of white to represent one or black to represent zero. A code word (preferably generated according to a CRC scheme) is included in the test pattern. The code word is chosen such that a predetermined syndrome will be generated when the test pattern is processed by a CRC circuit. Accordingly, the digital display unit samples the received analog signal with the test pattern encoded and processes the bits represented by the samples in a CRC circuit. If the CRC circuit generates the predetermined syndrome, the digital display unit determines that sampling frequency equals the original frequency.

Thus, the present invention provides a mechanism by which a display unit can determine the original frequency used by a graphics source to generate an analog display signal. This feature is provided by encoding the analog display signal with a sequence of test patterns that can be identified by the digital display unit. If the digital display unit correctly identifies one or more test patterns accurately, the corresponding sampling frequency equals the original frequency.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

1. Overview and Discussion of the Invention

In accordance with the present invention, a graphics source encodes a sequence of test patterns (test data) according to a predetermined convention. The graphics source encodes the test pattern at an original frequency in an analog display signal. The analog signal is then transferred to a display unit. The display unit samples the analog signal at a sampling frequency. The display unit varies the sampling frequency until the sampled values equal a test pattern. When the samples values equal the test pattern, the original frequency equals the sampling frequency at the time of sampling.

Each test pattern can be encoded into a portion of a frame (e.g., in a horizontal line) or can span multiple frames according to a predetermined convention. Both the graphics source and the digital display need to operate according to the convention. Several test patterns are generally transferred to provide sufficient time for the display unit to adaptively determine the original frequency.

One or more embodiments of the present invention will be described in further detail below. Before describing the invention in great detail, it is useful to describe an example environment in which the invention can be implemented. The details of making and using the invention will be clear from the description.

2. Example Environment

In a broad sense, the invention can be implemented in any computer system having a display unit. Such computer systems include, without limitation, lap-top and desk-top personal computer systems (PCS), work-stations, special purpose computer systems, general purpose computer systems, and many others. The invention may be implemented in hardware, software, firmware, or combination of the like.

Figure 1A:
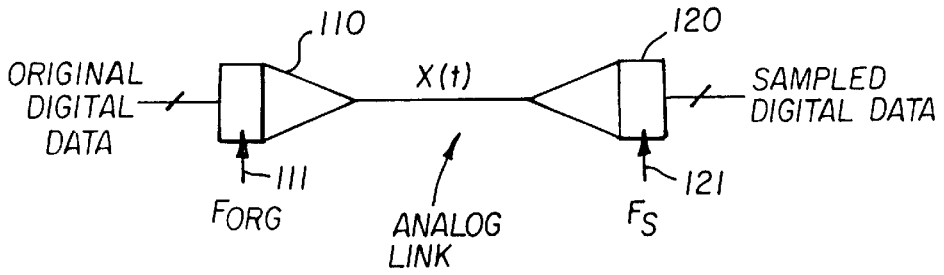
FIG. 1A is a block diagram of an analog to digital converter (ADC) and a digital to analog converter (DAC) connected by an analog link illustrating a typical scenario in which analog display signals generated by DAC are transmitted to ADC.
Figure 1B:
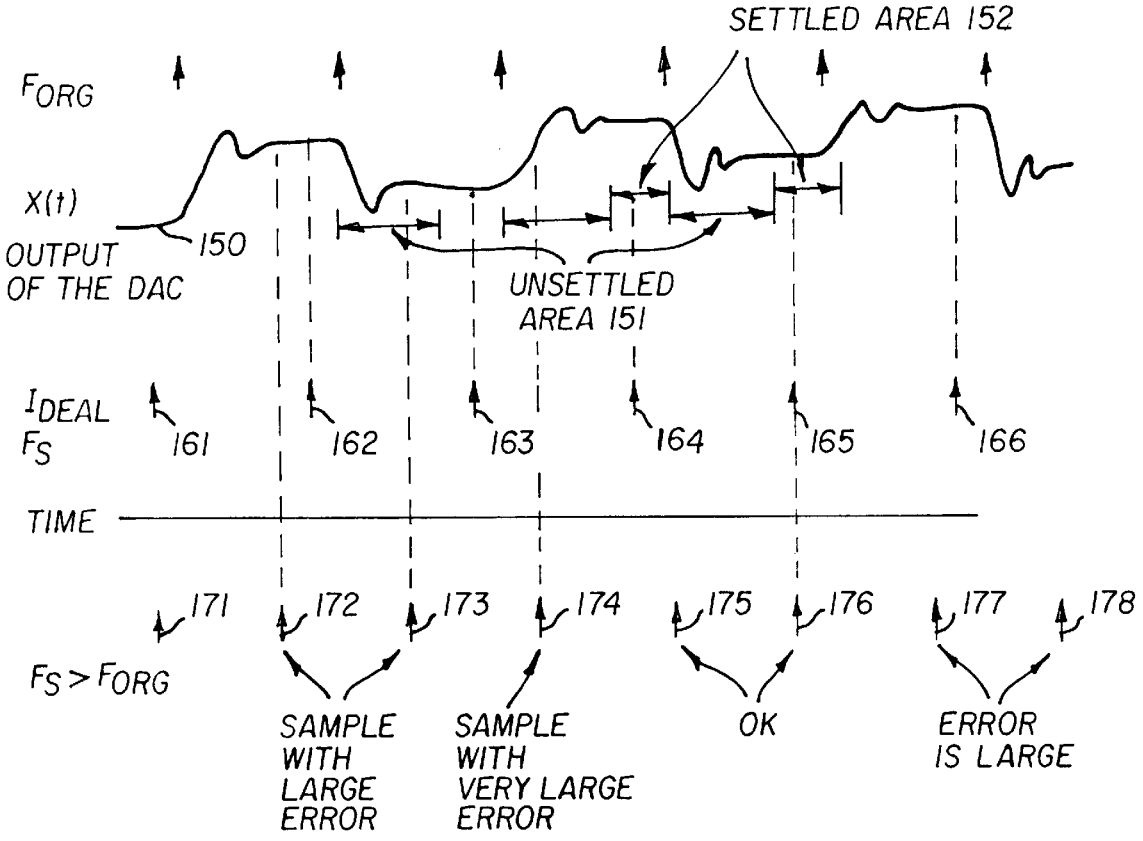
FIG. 1B is a diagram illustrating the need for the sampling frequency to be equal to the frequency used by DAC (original frequency) to generate the analog display signals.
Figure 2:
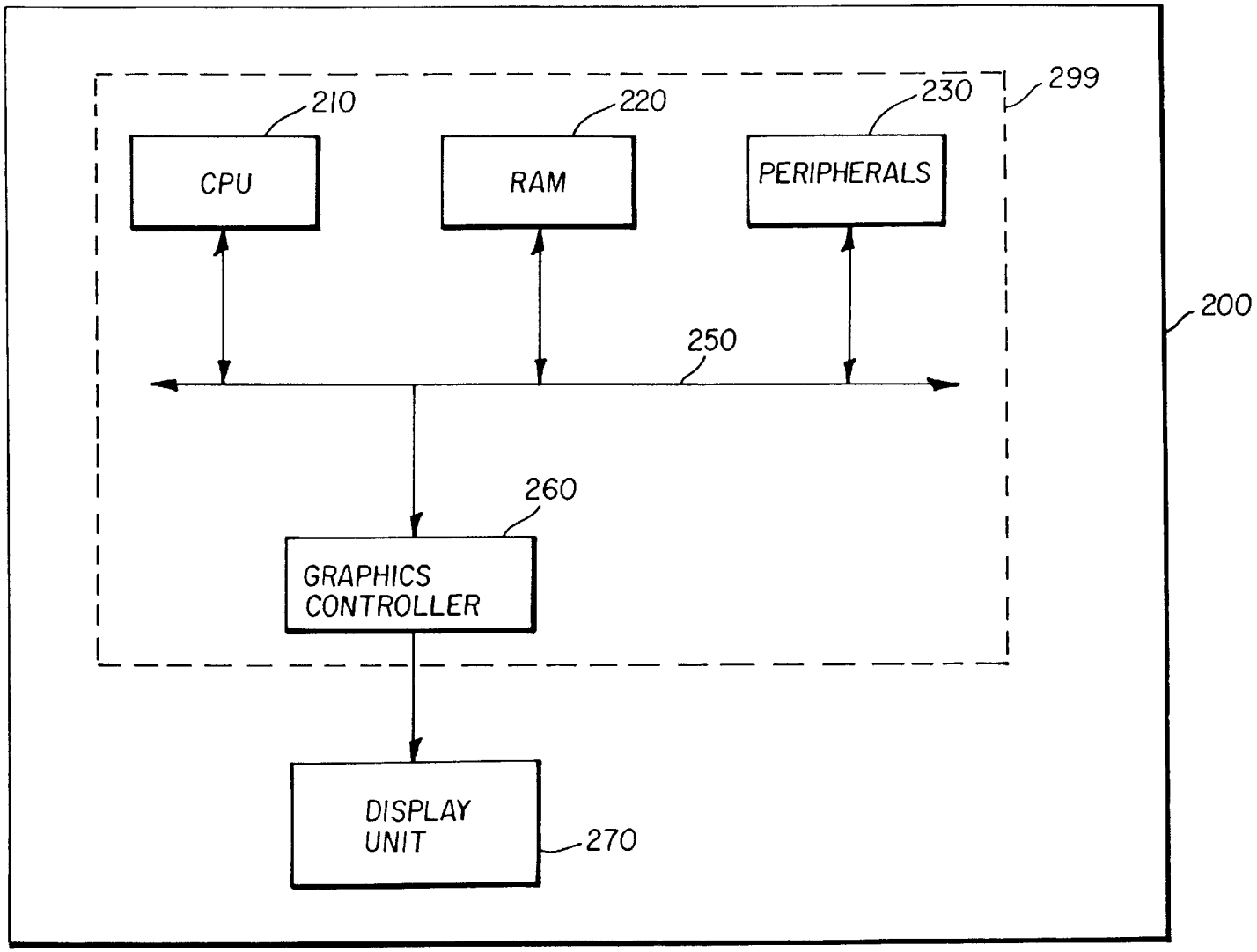
FIG. 2 is a block diagram of an example computer system in which the present invention can be implemented.

FIG. 2 is a block diagram of computer system 200 in which the present invention can be implemented. Computer system 200 includes central processing unit (CPU) 210, random access memory (RAM) 220, one or more peripherals 230, graphics controller 260, and digital display unit 270. CPU 210, RAM 220 and graphics controller 260 are typically packaged in a single unit, and such a unit is referred to as graphics source 299 as the analog display signal is generated by the unit. All the components in graphics source 299 of computer system 200 communicate over bus 250, which can in reality include several physical buses connected by appropriate interfaces.

RAM 220 stores data representing commands and possibly pixel data representing an image. CPU 210 executes commands stored in RAM 220, and causes different commands and pixel data to be transferred to graphics controller 260. Peripherals 230 can include storage components such as hard-drives or removable drives (e.g., floppy-drives). Peripherals 230 can be used to store commands and/or data which enable computer system 200 to operate in accordance with the present invention. By executing the stored commands, CPU 210 provides the electrical and control signals to coordinate and control the operation of various components.

Graphics controller 260 receives data/commands from CPU 210, generates an analog signal and a corresponding reference signal(s), and provides both to display unit 270. The analog signal can be generated, for example, based on pixel data received from CPU 210 or from an external encoder (not shown). Alternatively, graphics controller 260 can generate pixel data representative of a new image based on commands received, for example, from CPU 210. Graphics controller 260 then generates an analog signal based on such pixel data. In one embodiment, the analog signal is in the form of RGB signals and the reference signal includes the VSYNC and HSYNC signals well known in the art and explained in detail below. However, it should be understood that the present invention can be implemented with analog image data and/or reference signals in other standards. Examples of such standards include composite sync standard usually implemented on Macintosh Computer Systems and Sync on Green standard.

Digital display unit 270 receives the analog display signal from graphics controller 260 and generates the display signals. The display signals cause an image to be generated on a display screen usually provided within display unit 270. For an accurate reproduction of the image encoded in the analog signal, display unit 270 may need to determine the display signal parameters accurately. A general scheme for determining such display signal parameters is described in co-pending patent application entitled, "A Method and Apparatus for Automatically Determining Signal Parameters of an Analog Display Signal Received by a Display Unit of a Computer System", Ser. No. : UNASSIGNED, Filed Concurrently herewith, and having Attorney Docket Number: PRDS-0003, which is incorporated in its entirety herewith.

Digital display unit 270 of the present invention receives an analog display signal encoded with a sequence of test patterns (test data) from a graphics source (e.g., graphics controller 260). The content of each test pattern and manner in which it is encoded in the analog display signal is determined by the predetermined convention. Digital display unit 270 then determines the original frequency used by the graphics source to generate the received analog display signal by examining the analog display signal encoded with the test patterns. The operation and implementation of digital display unit 270 will be clear from the description below. The method of the present invention will be explained first, followed by an example pattern and an example implementation of digital display unit 270.

3. The Method of the Present Invention

Figure 3:
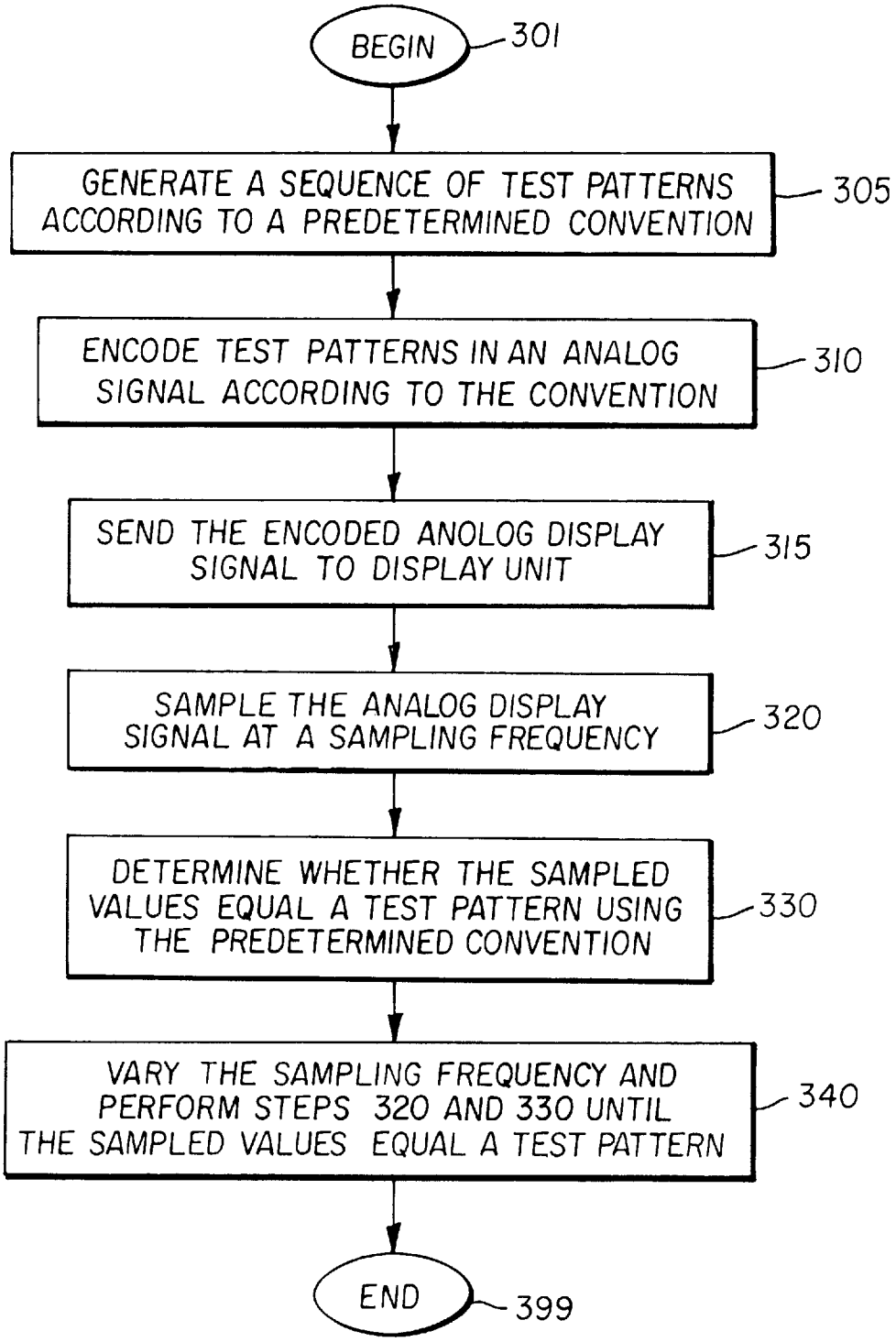
FIG. 3 is a flowchart illustrating the steps performed which enable a display unit to determine the original frequency automatically in accordance with one embodiment of the present invention.

FIG. 3 is a flowchart illustrating the steps performed in accordance with the present invention. The steps will be explained with reference to the example computer system 200 of FIG. 2. In step 305, a sequence of test patterns are generated in graphics source 299 by, for example, executing a series of software instructions. Each test pattern may include a fixed pattern (e.g., zeros and ones in alternate positions of each horizontal line) or an arbitrary sequence of bits. If a test pattern includes an arbitrary sequence of bits, a code value is appended which enables the display unit to reliably identify that a test pattern is encoded. Both cases will be explained below.

In step 310 of FIG. 3, graphics controller 260 encodes the test patterns (test data) as an analog signal. In step 315, graphics controller 260 sends the analog signal to display unit 270. In step 320, graphics controller 260, display unit 270 samples at a sampling frequency the received analog signal.

In step 330, display unit 270 determines whether the sampled values equal a test pattern. The convention employed in step 305 enables display unit 270 to 'know' the test pattern as explained below with examples.

In step 340, display unit 270 varies the sampling frequency if the sampled values are not equal to the test pattern. The sampling frequency is varied until the sampled values equal a test pattern. At that time, the sampling frequency equals the original frequency. Display unit 270 samples the subsequently received analog signals at the original frequency.

The present invention will be explained in detail below with specific examples. In the description there, computer system 200 will be assumed to operate in accordance with SVGA industry standard. However, the present invention can be implemented in other environments and/standards as will be apparent to one skilled in the art by reading the description provided herein.

Also, sections numbered 4–11 together describe an example convention in which a pre-specified sequence of bits (zero and one in alternate positions of a horizontal line) is used as a test pattern. Section 12 below describes a convention in which an arbitrary sequence of bits can be included in a test pattern.

In the scheme in which a pre-specified sequence of bits are encoded in horizontal lines, graphics source 299 uses the same communication path to send both the test data and the display data. Display data generally represents an image to be displayed on a display screen. Accordingly, it is necessary that the graphics source indicate to display unit 270 the presence of the test data.

The indication can be provided either manually or automatically. As an illustration of a manual scheme, a user may be required to manually indicate (e.g., by pressing button) that the display signal presently being received includes test data. In parallel, the user may initiate a program on a graphics source which sends an analog display signal encoded with the test data. On other hand, the indication can be provided automatically, for example, when the user initiates a program to send test data. The manner in which such an indication can be provided automatically will be described first in the context of a scheme which enables the determination of various display signal parameters.

Figure 4:
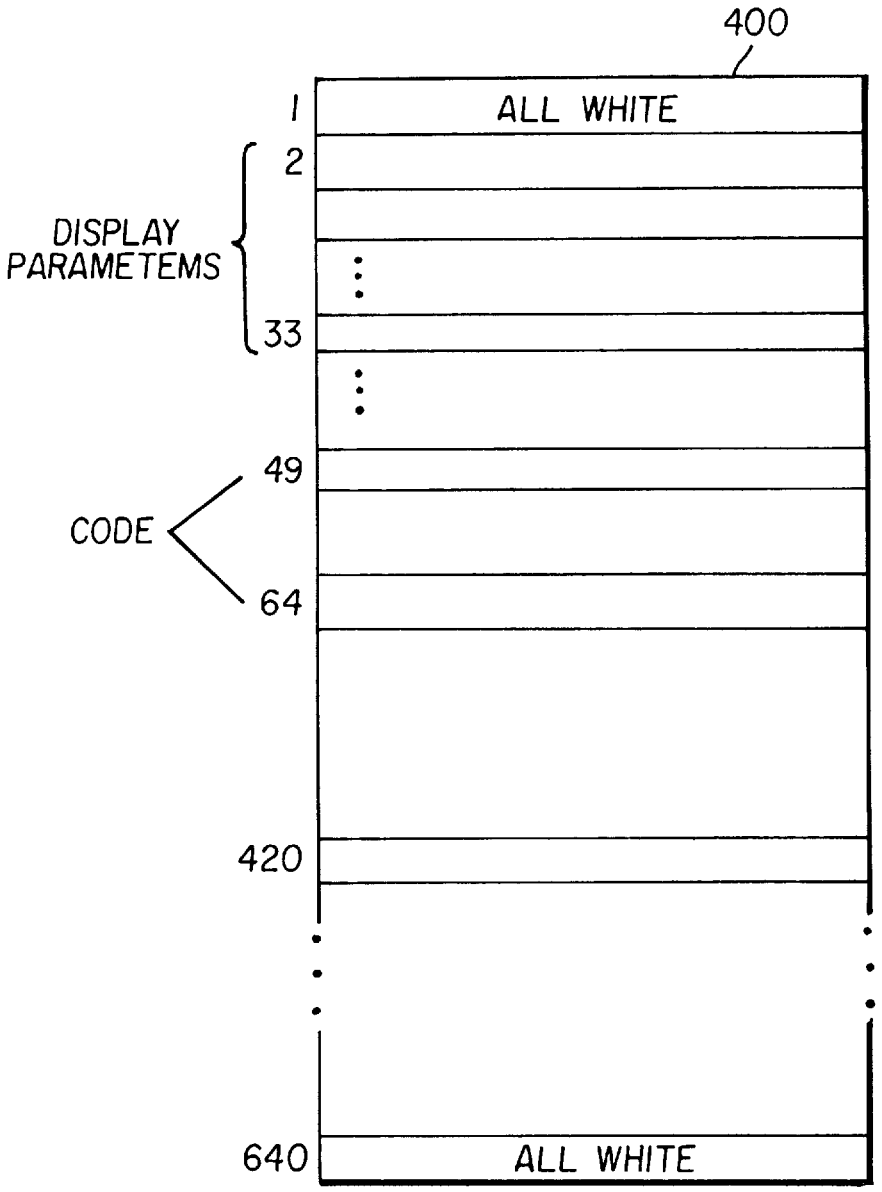
FIG. 4 is a diagram illustrating an example frame format used to indicate to a display unit that a test pattern is encoded in the analog signal.

4. An Example Scheme Enabling Display Unit to Determine Various Display Signal Parameters FIG. 4 is a diagram illustrating the manner in which graphics controller 260 can encode data of a predetermined format in an analog signal. The data in frame 400 is encoded according to a predetermined convention. The encoding is generally performed to enable display unit 270 to determine various display signal parameters. One of several encoding schemes can be chosen as will be apparent to one skilled in the art by reading the description provided herein.

As to lines 1 and 640, all points are noted as being encoded with data representing white color. As the entire lines have a voltage level representing complete brightness, display unit 270 can determine the voltage level which is being used by graphics controller 260 to represent complete brightness. In addition, as the start position of line 1 includes a white value, display unit 270 can measure the horizontal start delay time and the vertical start delay time, and can thus determine the horizontal start position and vertical start position. Similarly, display unit can determine horizontal end position from the last position of line 1, and the vertical end position from the last position of line 640. It should be noted that for determining the timing parameters, it may be sufficient that the entire first and last lines (or the first and last points) be encoded with a color value greater than a predetermined threshold.

Lines 2–33 are used to encode other display signal parameter values which may be available only in graphics source 299. These type of parameters can be ascertained on graphics source 299, and sent to display unit 270. For example, it is helpful to know the number of colors used by graphics source 299 to represent an image. With this information, the same number of clear colors can be provided on display unit side. As an illustration, if a graphics source uses 256 colors to represent each pixel of an image, the image can be accurately reproduced without regard to some level of deviations in analog representation if display unit 270 also samples each point using 8-bit encoding.

Lines 2–33 can also be used to encode the total number of pixels (HTOTAL) in each horizontal line of an image representation on graphics source 299. In one embodiment, HTOTAL may can be equal to horizontal period Th divided by original frequency on graphics source 299. By examining the HSYNC signal, Th can be determined in graphics unit and the original frequency can be computed by dividing HTOTAL by Th.

However, one problem with such a scheme is that ascertaining HTOTAL value at some types of graphics sources may be problematic. For example, an operating system on a graphics source may not provide easy programmable interface to query HTOTAL. Accordingly, the present invention provides an easier scheme which can be readily ported onto different type of graphics sources.

In one embodiment of the present invention, several horizontal lines of frame 400 are encoded with alternate pixels of zeros and ones. For example, lines 65–75 are encoded with alternate pixels of zeros and ones. In an alternative embodiment, several lines of several frames immediately following frame 400 (with code 499 encoded) are encoded with alternate pixels of zeros and ones. In either embodiment, using these lines, display unit 270 can determine the original frequency used in graphics source 299 for generating as will be explained in detail below.

The analog signal carrying the encoded data is sent over the same communication path as that over which normal image display data is sent. Therefore, there needs to be a mechanism for graphics source 299 to indicate to display unit 270 that an analog signal frame includes test patterns that can be used for the determination of display signal parameters. Accordingly, display unit 270 can automatically determine that analog signal encoding frame 400 represents a test pattern with the predetermined format.

Thus, lines 49–63 are used to encode a code value (hereafter referred to as code word 499) which serves to identify whether an analog display signal frame represents normal display signal or test data with a predetermined format which can be used for determining the original frequency. It should be understood that the detection of presence of a test pattern is generally more accurate with more bits in test code (or code value) 499. As typical graphics controller standards include at least 200 lines per frame, more lines can be used to communicate additional information and to have code value 499 with more number of bits. The manner in which code value 499 communicates the presence of a test pattern in an analog signal frame will be explained below.

In an example encoding scheme, only one bit is encoded in each horizontal line. This is because, display unit 270 may not have the clock to accurately sample multiple positions within a horizontal line. However, HSYNC signal can serve to indicate a transition to a next horizontal line. One of several schemes can be used to encode one bit of data per line as will be explained below. Different schemes of encoding which can allow a different number of bits can be implemented as will be apparent to one skilled in the art by reading the description provided herein.

In a first embodiment, to represent a value of 1 in a horizontal line, the entire line is encoded with white color. A zero value is represented by encoding the whole line with a black color. In a first alternative embodiment, zero value is represented by encoding the whole line with black color. However, a logical value of one is represented by mixing black and white pixels in a predetermined sequence and ratio. For example, K white pixels may be sent first, followed by L black pixels, which are then followed by N white pixels, where K, L and N are predetermined integers. As will be appreciated, such a mixing ensures that black and white pixels are available in frame 400, which facilitates the determination of voltage levels used in encoding black and white colors at display unit. In yet another alternative embodiment, the frequency of changes from black to white can be used to encode 0 and 1 values. For example, a high frequency can indicate a logical value of 1, and low value will indicate a logical value of 0.

In another alternative embodiment, a line encoded with alternate pixels of black and white to represent 1. As will be appreciated, this encoding scheme can be used to determine the original frequency and lines 65–75 described above may be used for other purposes.

In the rest of the description, it will be assumed that a logical value of 1 is encoded using white color in a complete horizontal line and a logical value of 0 is encoded using black color in an entire horizontal line. Thus, display unit 270 needs to only determine whether a line is encoded above or below an intermediate color threshold. In a scheme where display unit 270 samples the analog signal encoding the test data, only the most significant bit (MSB) of one of the sampled values needs to be examined to determine whether the horizontal line is encoded with 0 or 1 value as will be explained below in further detail with reference to FIG. 5.

5. An Example Scheme for Automatically Communicating the Presence of a Test Pattern in an Analog Display Signal As noted earlier, an indication that data encoded in a frame comprises test data is sent to display unit 270. Several schemes can be used to send such an indication as will be apparent to one skilled in the relevant arts by reading the description provided herein. In the example implementation described herein, well-known CRC techniques commonly used for error correction and detection are employed. The CRC techniques employed will be described briefly here. However, for a more detailed description, the reader is referred to, "Error-Correcting Codes", $2^{nd}$ Edition, MIT Press, Cambridge, Mass. 1972, by W. W. Peterson and E. J. Weldon, which is incorporated herein by reference in its entirety.

Broadly, a CRC code is generated on graphics source 299 by dividing the data to be sent with a predetermined generating polynomial. The remainder is adjusted to generate code word 499. The code word is generated to have a value such that a predetermined syndrome will be generated when the test data (including the code word) is processed by a CRC syndrome generator in display unit 270.

There can be more than one predetermined syndromes, with each predetermined syndrome potentially being designed to provide different information. For example, a first predetermined syndrome may indicate that subsequent display signal frames will have test patterns. A subsequent frame may be encoded with a different syndrome to indicate the actual test data which lends to the determination of display signal parameters. However, in the description below, test data and indication of the presence of test data are described as being encoded within a single frame.

Thus, digital data frame 400 (including test data and code word) is encoded as an analog signal frame and the analog signal frame including the test data is transferred to display unit 270. The data encoded in analog signal frame is decoded and processed in a CRC generator in display unit 270. When the CRC generator in display unit 270 generates that predetermined syndrome, display unit 270 can determine that test data (with predetermined format) has been sent. Display unit 270 can then determine the display signal parameters.

Typically, code word 499 is generated by executing a series of software instructions on graphics source. However, in display unit 270, due to the timing constraints, a hardware circuit may be employed to determine whether a predetermined syndrome will be generated. The software scheme and an example hardware circuit will be explained below with examples. The examples will be described in terms of four bits of data being transmitted with three bits of code word. However, it should be understood that in reality much longer code words are preferably employed to avoid the possibility of false determinations of presence of test data by display unit 270. For example, display unit 270 will be described below as including a 16-bit code word.

In the example description here, it will be assumed that data to be transmitted is 1010, the predetermined generating polynomial is $X^3+X^1+1$ and a predetermined syndrome is 111. To generate the codeword which causes the predetermined syndrome to be generated, the data to be transmitted 1010 is first padded with three zeros to the right to generate 1010000. This number 1010000 is divided by the generating polynomial (1011) to generate a remainder of 011. As is well known in the art, to cause a predetermined syndrome to be generated at the receiving end, the desired syndrome is added modulo 2 to the remainder. Thus, assuming 111 is a desired syndrome, 100 (resulting from module 2 addition of 011 and 111) is added as a code word. Thus, the test data transmitted will be 1010100, wherein the last three digits are the generated code word. The test data is encoded as an analog signal and transmitted to display unit 270.

Display unit 270 receives the analog signal, decodes the digital data encoded in the analog signal, and processes the decoded data through a CRC syndrome generator circuit. If the resulting syndrome equals a predetermined expected syndrome value, display unit 270 can determine or conclude that the decoded data represents a test pattern with a predetermined format, and the received analog signal (and encoded data) can be used for determining signal parameters. A 3-bit CRC syndrome generator circuit will be explained below with reference to an implementation of display unit.

6. Example Embodiment of Digital Display Unit

Figure 5:
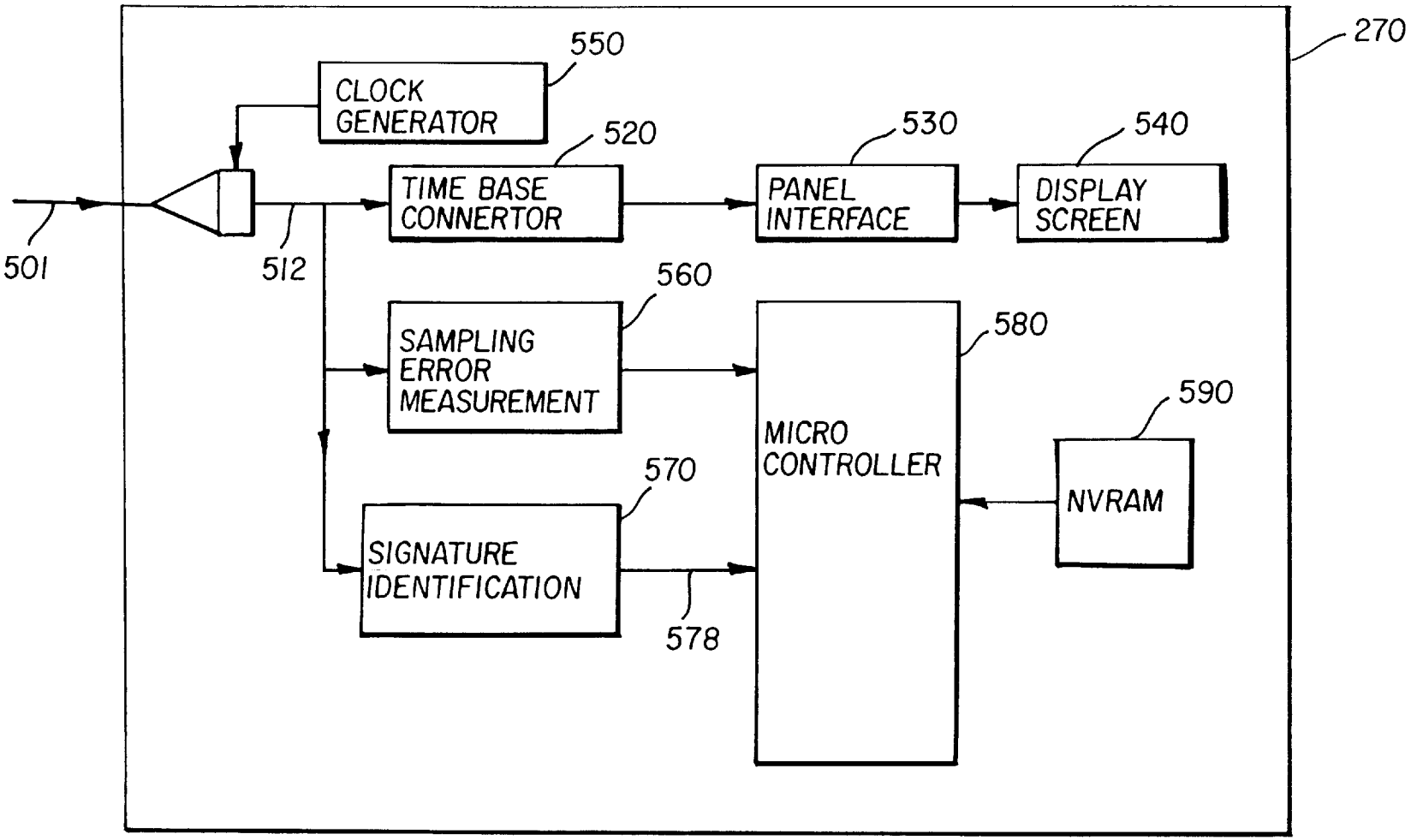
FIG. 5 is a block diagram of an embodiment of a display unit of the present invention.

FIG. 5 is a block diagram of digital display unit 270 including analog-to-digital converter (ADC) 510, time base convertor (TBC) 520, panel interface 530, clock generator circuit 550, digital display screen 540, sampling error measurement block 560, signature identification block 570, micro controller 580 and non-volatile memory 590. Each of these components will be explained in further detail below.

Digital display unit 270 can include other components for determining other display signal parameters, which are described in further detail in co-pending patent application entitled, "A Method and Apparatus for Automatically Determining Signal Parameters of an Analog Display Signal Received by a Display Unit of a Computer System", Ser. No. : UNASSIGNED, Filed Concurrently herewith, and having Attorney Docket Number: PRDS-0003, which is incorporated in its entirety herewith.

Clock generator 550 generates a sampling clock with frequency $F_s$. The sampling clock is used by ADC 510 for sampling the analog signal received on line 501. An embodiment of clock generator is explained in co-pending patent application entitled, "A Method and Apparatus for Clock Recovery in a Digital Display Unit", Filed Feb. 24, 1997, having Ser. No. 08/803,824 and Attorney Docket Number: PRDN-0002.

ADC 510 samples the analog signal received on line 501 according to sampling clock 551 received from clock generator 550. The analog signal received on line 501 can either represent test patterns (e.g., frame 400) or normal display signal frame. The sampled data values are provided on line 512 to TBC 520 and sampling error measurement block 560. Time base converter 520 upscales or downscales the source image represented by analog signal if necessary. An embodiment for upscaling is described in co-pending patent application entitled, "A Method and Apparatus for Upscaling an Image", Filed Feb. 24, 1997, having Ser. No. 08/804,623 and Attorney Docket Number: PRDN-0001.

Sampling error measurement block 560 examines the sampled values to determine whether any sampling errors are present. Sampling errors are said to be present if the sampled values do not equal a test pattern. The determination is performed according to the format of the test pattern. Thus, if the test pattern includes black and white pixels in alternate positions of a horizontal line, sampling error measurement block 560 measures the number of consecutive black or white pixels in the sampled data. An example implementation will be explained in detail below.

Signature identification block 570 receives sampled values and determines whether data encoded in a frame represents test data. Signature identification block 570 needs to be implemented according to the scheme chosen to indicate the presence of a test pattern at graphics source 299. In the example scheme based on CRC techniques described above, signature identification block 570 uses code word 499 to determine the presence of test pattern in the received analog signal frame. An example embodiment for making such a determination will be explained in detail below. Signature identification block 570 asserts a signal on update line 578 when it determines that a test pattern is received.

Micro-controller 580 receives on update line 578 from signature identification block 570 an indication of reception of a test pattern. In one embodiment, several frames following the frame which triggered the indication can contain test patterns. During the reception of test pattern(s) which enables display unit 270 to determine the original frequency, micro-controller 580 controls the operation of clock generator circuit 550 to vary the sampling frequency $F_s$ generated by clock generator circuit 550 in accordance with the present invention. As used in the present application, micro-controller 580 can be any circuit which controls the sampling frequency to determine the sampling frequency. Micro-controller 580 can vary the clock frequency, for example, by changing the parameter HTOTAL (the divisor in the feedback loop of PLL).

When the error measurement is zero, micro-controller 580 determines that the frequency at which clock generator 550 is operating equals the original frequency $F_{org}$ used a graphics source. The details will be illustrated in reference to an example embodiment of sampling error measurement block 560 described below. Micro-controller 580 may then store in non-volatile memory 590 values representing the correct value of $F_{org}$. Once stored, these values may be retrieved and used by micro-controller 580 in controlling the subsequent image reproduction operations. The manner in which such control can be accomplished will be apparent to one skilled in the relevant arts.

Non-volatile memory 590 can be used to store several sets of parameters, with each parameter set corresponding to a mode of operation. For example, one set may be stored for one graphics mode (VGA) and another set may be stored for SVGA mode. In one embodiment, non-volatile memory 590 is implemented using an EEPROM.

Thus, micro-controller 580 determines the presence of a test pattern having a predetermined format based on a signal asserted by signature identification block 570. The manner in which signature identification block 570 makes such a determination in one implementation of the present invention will be explained in detail below.

7. Example Implementation of Signature Identification Block

As noted above, the implementation of signature identification block needs to be consistent with the implementation on graphics source for a proper determination of the presence of test pattern. Several schemes will be apparent to one skilled in the relevant arts by reading the description provided herein. In this section, an implementation which operates in conjunction with the format and scheme explained with reference to FIG. 4 will be described below.

Figure 6:
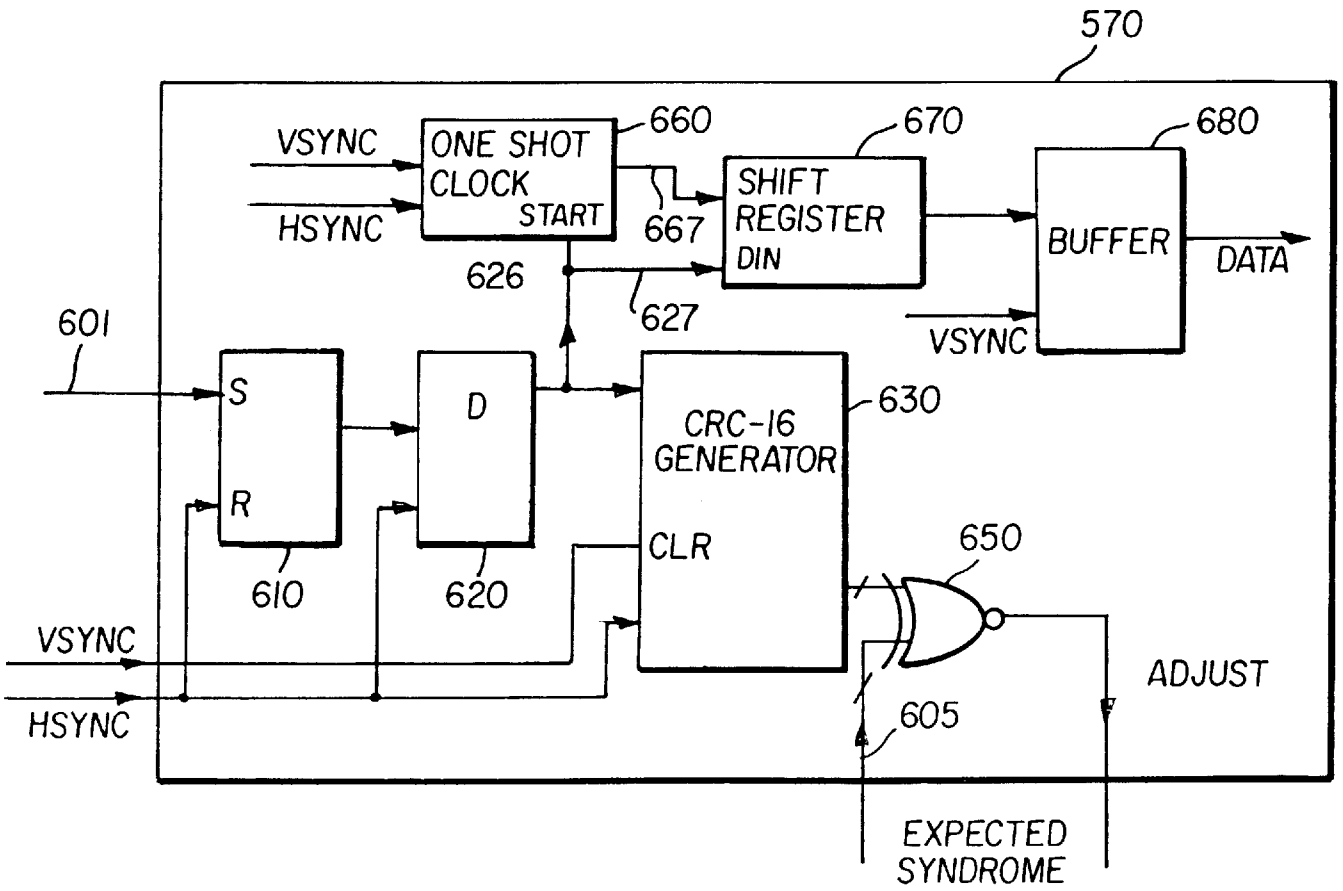
FIG. 6 is a block diagram of an embodiment of signature identification block illustrating the components therein.

FIG. 6 is a block diagram of an example implementation of signature identification block 570 including flip-flop 610, delay element 620, CRC generator 630, XNOR gate 650, one-shot circuit 660, shift register 660, and buffer 680. HSYNC signal provides a clock signal to each of these components. Broadly, CRC syndrome generator 630 and XNOR gate 650 together generate a signal indicative of whether a test pattern has been received. One-shot 660, shift register 670 and buffer 670 together operate to store the bits encoded in the predetermined horizontal lines, which store the signal parameter values (e.g., lines 2–33 in FIG. 4).

S-R flip-flop 610 receives the most significant bit of output of ADC on line 601. Flip-flop 610 is cleared by HSYNC signal. Thus, flip-flop 610 receives a 1 or 0 depending on whether a horizontal line was encoded with white or black color respectively. Delay element 620 is clocked by HSYNC and operates to store the data bit received during a previous horizontal line.

CRC generator 630 sequentially receives each of the 63 bits of data (shown in lines 2–64 of FIG. 4) from delay element 620 and generates a syndrome value, which is used to determine whether a test pattern is encoded in a received signal frame. As already noted, the determination is generally more reliable with more number of bits in the generated code value 499 or syndrome. Thus, CRC generator 630, is implemented to generate a 16-bit syndrome. This length is consistent with the 16 bits of test code 499 encoded in frame 400 described above. However, for simplicity, examples of CRC code generation and syndrome generation will be explained with a length of only 3-bits as also noted above.

VSYNC pulse resets the state of CRC generator 630 and HSYNC pulse causes the data to be processed and shifted to a next stage. The output of CRC generator 630 includes all the bits of the computed syndrome. XNOR gate 650 performs a logical XNOR operation of the computed syndrome with an expected syndrome received on line 605. The expected syndrome value can be received from a programmable register. As already explained, each of the expected syndrome values can be used to communicate a different message.

A logical value of 1 (for each bit) on the output of XNOR gate 650 indicates CRC syndrome generator 630 has generated a value equal to the desired syndrome received on line 605. For one of such desired syndrome values, display unit 270 determines that a test pattern is received. In response to such an indication, micro-controller 580 receives the parameter values measured by sampling error measurement block 560 (shown in FIG. 5) and the other display parameters sent from the graphics source. These other display parameters will be available in buffer 680 as will be explained below.

In the description above, the presence of a test pattern is determined based on data received in one display signal frame. One problem with such a determination is that some sequences of non-test data (normal user data) can cause erroneous determination of presence of test data pattern. To avoid such erroneous determinations, in one alternative embodiment, the determination of presence of test pattern is based on multiple consecutively received frames. According to one convention, such consecutively received frames should return a predetermined sequence of syndrome values. For simplicity and clarity, it will hereafter be assumed that the determination of the presence of test frame is based on a single frame (i.e., by XNOR gate). More complex, but reliable, schemes will be apparent to one skilled in the relevant arts by reading the description provided herein.

One-shot circuit 660 generates a capture signal (logical level 1) on line 667 for a duration on M clock cycles after receiving a first logical 1 value on line 626. HSYNC signal provides the clock signal and VSYNC prepares one-shot circuit 660 to wait for the first logical 1 value on line 626. As the first line in test pattern is encoded with a white color (see FIG. 4 and explanation of above), the first logical 1 value is received delayed by a time corresponding to the delay introduced by delay element 620. As the display signal parameters sent from host computer side are encoded from the second line only, the first bit may be ignored. Accordingly, the first logical value of 1 is provided on line 626 to START input with a delay of one clock cycle.

Figure 8:
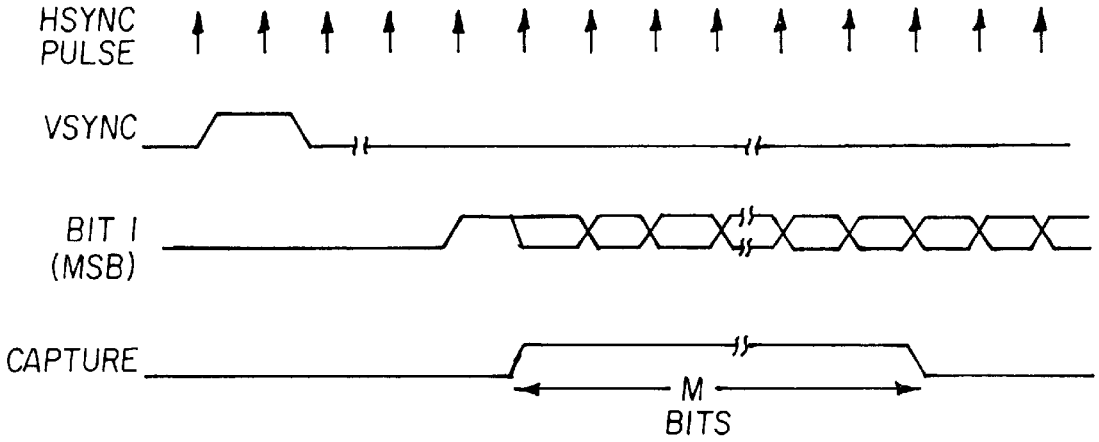
FIG. 8 includes timing diagrams illustrating the operation of a one-shot clock circuit included in the signature identification block.

In addition, the value of M corresponds to the number of lines storing display signal parameters in frame 400. In the example explained there with reference to FIG. 4, M=32. That is, 32 bits of data representing display signal parameter values are encoded in frame 400. Thus, one-short circuit 660 generates a capture signal on line 667 for a duration equaling 32 clock cycles (HSYNC pulses). One of several circuits available in the market place can be used for one-shot circuit 660. FIG. 8 includes timing diagrams which further illustrate the operation of one-shot circuit 660. Capture signal is shown transitioning to a logical high level one HSYNC pulse after a first logical level 1 is received on line 626. The capture signal remains at a high logical level for M HSYNC pulses, enabling M bits to be captured in shift register 670.

Continuing the description with reference to FIG. 6, shift register 670 receives bits serially on line 627 and stores each received bit when the capture signal is asserted on line 667. Thus, shift register 670 stores the desired 32 bits in response to 32 successive HSYNC pulses. When VSYNC pulse is asserted, the M bits are transferred to buffer 680. Accordingly, micro-processor 580 can retrieve these display signal parameter values from buffer 680 after the end of the present frame of analog signal. Micro-computer 580 uses the parameters to reproduce (display) images in subsequently received analog signal frames.

Thus, signature identification block 570 asserts a signal indicating the presence of test data in a received analog signal and also provides the display signal parameters sent from graphics source 299. As explained earlier, CRC generator 630 detects the presence of test data in a received analog signal frame. The design and implementation of CRC syndrome generator 630 will be illustrated now with a circuit that generates a three bit syndrome value for simplicity.

8. An Embodiment of CRC Generator

Figure 7:
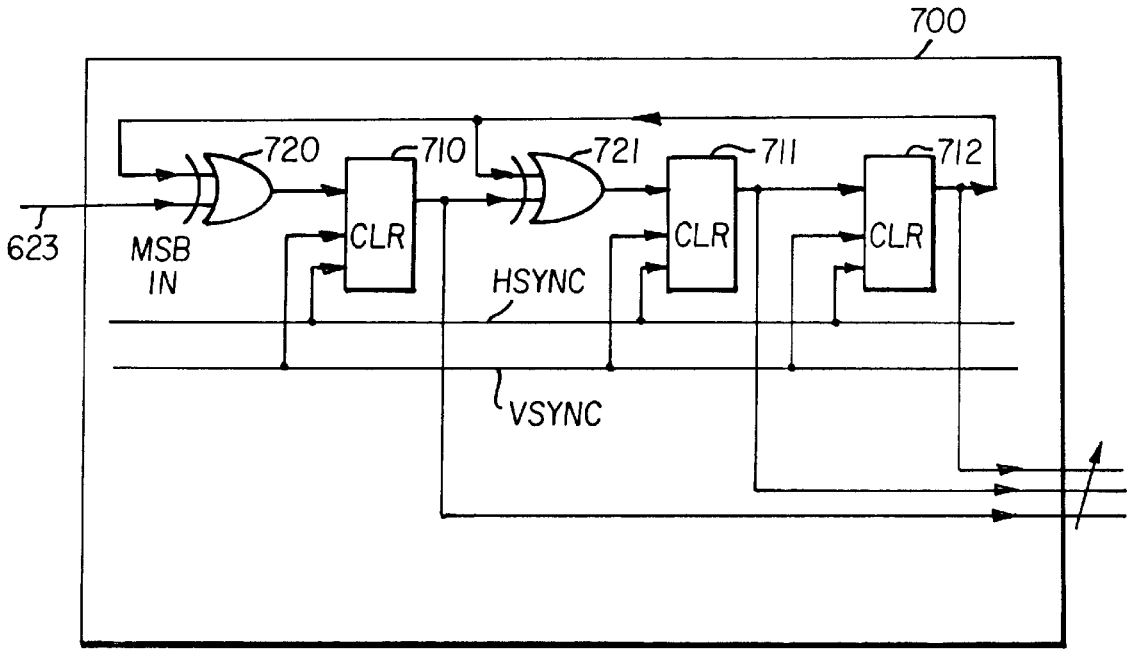
FIG. 7 is a block diagram of an example CRC generator implemented within signature identification block.

FIG. 7 is a block diagram of a CRC generator 700 for generating a three-bit syndrome which enables a determination as to whether the received data includes a test pattern. CRC generator 700 implements a division based on the predetermined generating polynomial $X^3+X^1+1$. CRC generator 700 includes delay elements 710, 711 and 712, $XOR^3$-gates 720, 721.

In operation, each bit of the received test pattern (first bit of lines 1–64 of FIG. 4) is fed sequentially on input line 623 XOR gate 720 during each clock cycle. As each bit of the test data is encoded in one horizontal line and as each horizontal line can be identified by a HSYNC pulse, each bit can be easily decoded. The bits are modified and/or propagated through XOR-gates 720, 721 and XOR gates 720, 721 in response to each HSYNC pulse. After all the bits are fed on input line 702, the outputs of delay elements 720, 721 and 722 will have the bits representing the syndrome value.

As already noted, the circuit for generating a three-bit syndrome is explained for illustration only. In practical applications, syndromes with many more bits should be employed to avoid false indications of presence of test data. The syndrome value generated according to the above design is provided as an input to XNOR gate 650 as described above to determine whether all bits are equal to one. If the generated syndrom equals the expected syndrome, an indication is provided to micro-controller 580 that a test pattern has been received.

Upon receiving an indication of presence of a test pattern in the received display signal frame, micro-controller 580 controls the operation of clock generator 550 to determine the original frequency used by graphics source 299 to generate analog display signal. The manner in which the original frequency is determined will be explained in detail below.

9. Determining the Original Frequency by Examining the Display Signal Encoded with the Example Test Patterns Described Above As explained above, in an example scheme in accordance with the present invention, several horizontal lines are encoded with zero and one in alternate positions. In this case, each horizontal line may be viewed as a test pattern. However, a different number of lines (possibly spanning multiple frames) can be used as a test pattern as long as the predetermined convention so specifies. The horizontal lines can be in a single frame 400 or in immediately following frames or according to any predetermined convention. Typically, several successive frames include the test patterns to provide sufficient time for display unit 270 to adaptively determine the original frequency. By examining these predetermined horizontal lines, display unit 270 determines the original frequency as explained below with reference to FIGS. 9, 10 and 11.

Figure 9:
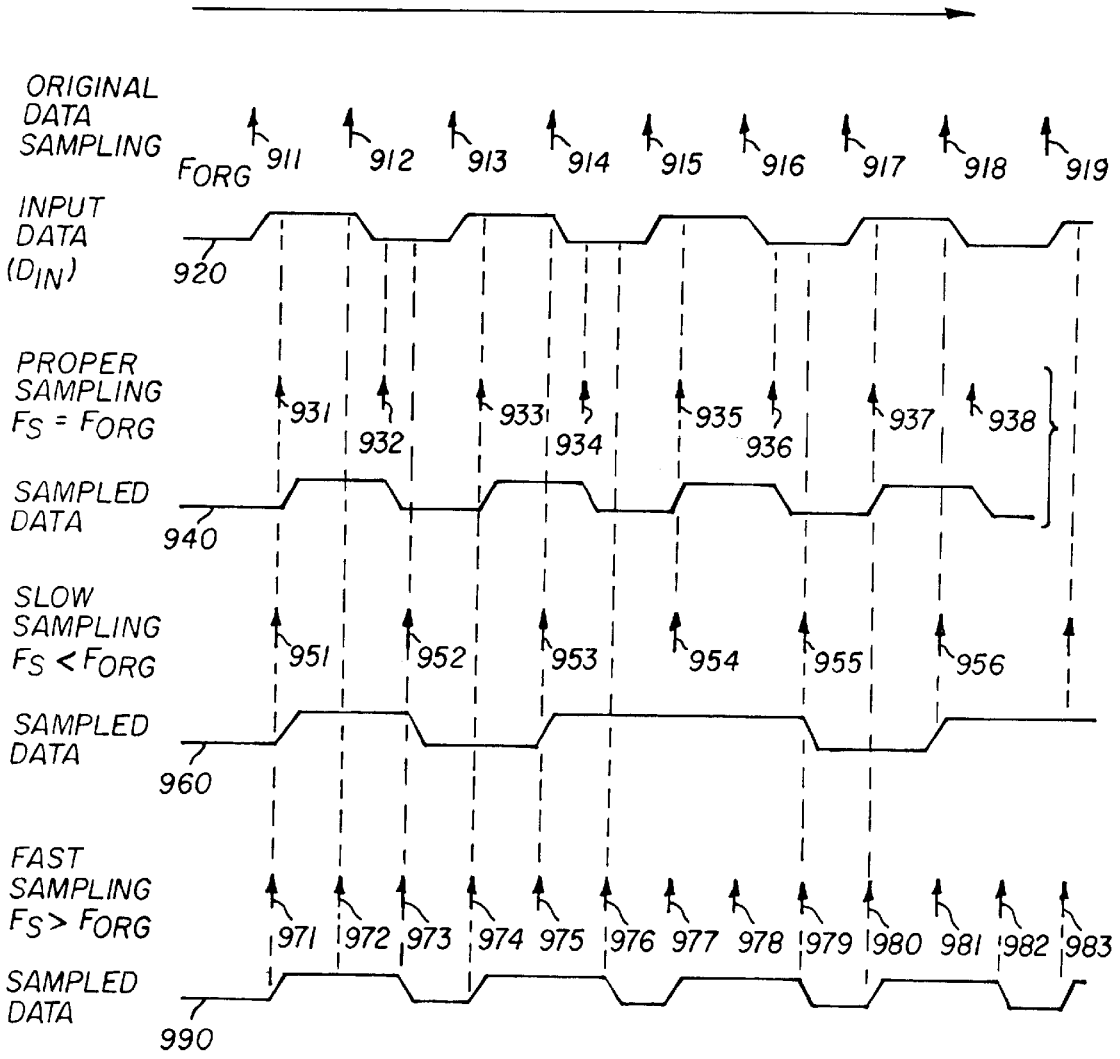
FIG. 9 is a diagram which illustrates that runs (defined as consecutive values of 0 or 1) are encountered by sampling the analog signal encoded with the test data if the sampling frequency is not equal to the original frequency.

FIG. 9 is a diagram which illustrates that runs (defined as consecutive values of 0 or 1) are encountered by sampling the analog signal encoded with a test pattern if the sampling frequency $F_s$ is not equal to $F_{org}$. Thus, the absence of runs in sampling a test pattern indicates that the sampling frequency equals the original frequency.

Signal 920 represents the analog signal represented by zeros (black color) and ones (white color) in alternate positions of a horizontal lines. Analog signal 920 is generated using original frequency $F_{org}$. 911–919 represent the rising edges of the original clock.

Signal 940 represents the sampled values when analog signal 920 is sampled using a sampling frequency $F_s$ which equals $F_{org}$. The rising edges of the sampling clock are shown as 931–938. As can be readily observed from signal 940, the alternate values of zeros and ones are recovered. In other words, there are no runs.

Signal 960 represents the sampled values when analog signal 920 is sampled using a sampling frequency $F_s$ which is less than $F_{org}$. The rising edges of the sampling clock are shown as 951–958. As can be readily observed from signal 960, a run of two ones is encountered by sampling at 953 and 954.

Similarly, signal 980 represents the sampled values when analog signal 920 is sampled using a sampling frequency $F_s$ which is greater than $F_{org}$. The rising edges of the sampling clock are shown as 971–978. As can be readily observed from signal 990, a run of two ones is encountered by sampling at 971 and 972, 974 and 975, 977 and 978 etc.

From the above, it can be observed that the run count is zero when sampling frequency $F_s$ equals $F_{org}$. Using this observation, several embodiments can be made in accordance with the present invention. It should be understood that a different predetermined pattern can be used for determining the original frequency without departing from the scope and spirit of the present invention as will be apparent to one skilled in the art by reading the description provided herein. An example embodiment which operates with the above described sample format will be explained below.

10. An Example Method of Determining the Original Frequency

When signature identification circuit 570 indicates the presence of a test pattern, micro-controller 580 examines the output (RUN-COUNT) of sampling error measurement block 560. RUN-COUNT represents the number of runs (consecutive values of 0 or 1) in a horizontal line of the analog signal. If RUN-COUNT is equal to zero, the present sampling frequency equals the original frequency.

If RUN-COUNT is not equal to zero, micro-controller 580 needs to increase or decrease the sampling frequency $F_s$ until it equals $F_{org}$. The decision whether to increase or decrease the sampling frequency depends on whether $F_s$ is less than or more than $F_{org}$. It may not be clear whether $F_s$ is less than or greater than $F_{org}$.

Therefore, in one embodiment, micro-controller 580 first increases the sampling frequency $F_s$ by a small amount and measures the RUN-COUNT for this increased sampling frequency. If the RUN-COUNT decreases, micro-controller 580 determines that the sampling frequency $F_s$ needs to be further increased until RUN-COUNT becomes zero. On the other hand, if RUN-COUNT increases, micro-controller 580 determines that the $F_s$ needs to be decremented to less than the original value (i.e., the sampling frequency used the first time).

After determining whether to increment or decrement the sampling frequency, micro-controller 580 can use the RUN-COUNT to determine the extent to which sampling frequency is incremented or decreased. In general, a higher value of RUN-COUNT implies that the sampling frequency should be changed by a large value. Micro-controller 580 modifies $F_s$ until RUN-COUNT is measured to be zero. Once RUN-COUNT is measured to be zero, the value of $F_s$ equals the original frequency or a harmonic of the original frequency.

To ensure that the determined frequency is not a harmonic of the original frequency, the test data may include data having a different spatial frequency (e.g., repeat a pattern having two ones followed by a zero) according to a predetermined convention. The pattern with this different spatial frequency can be sampled with various harmonics of the frequency when RUN-COUNT was originally determined to be zero. When the set of sampled values equals the test pattern, the sampling frequency equals the original frequency. Other techniques to ensure that the determined frequency is not a harmonic of the original frequency will be apparent to one skilled in the art by reading the description herein can be employed. An embodiment of sampling error measurement block 560, which generates RUN-COUNT will now be explained in further detail below.

11. Example Embodiment of Sampling Error Measurement Block

Figure 10:
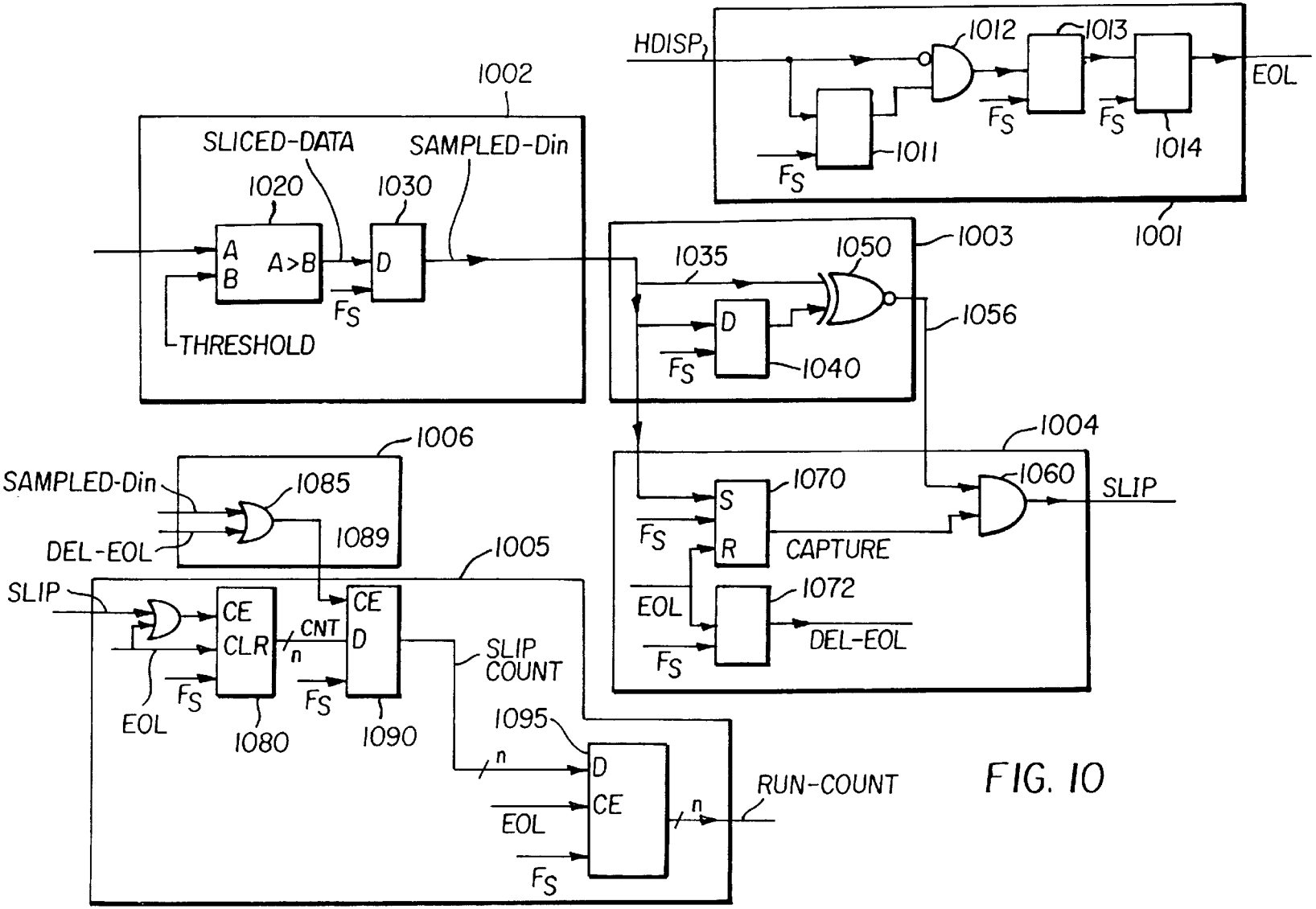
FIG. 10 is a block diagram of a circuit which measures the number of runs in a horizontal line.

FIG. 10 is a block diagram of sampling error measurement block 560 in one embodiment of the present invention. Sampling error measurement block 560 indicates whether the sampled values equal a test pattern. In addition, sampling error measurement block 560 of FIG. 10 indicates the number of errors in the sampled values for each line.

Broadly, block 1001 generates an EOL signal, which is at a high logical level for one sampling clock ($F_s$) duration on a falling edge of HDISP signal. Block 1002 generates a value of 1 if a sampled value (received on input A) is greater than a predetermined threshold (received on input B), and a value of 0 otherwise. Block 1003 asserts the line 1056 to a high logical value if a run condition (consecutive zeros or ones) is detected. Block 1005 counts the number of runs and stores the count for subsequent processing by micro-controller 580. Blocks 1004 and 1006 ensures that runs received during retrace period (period during which active display is not present) are not counted as runs by block 1005. Each of these blocks will be described in further detail with reference to FIGS. 10 and 11.

Figure 11:
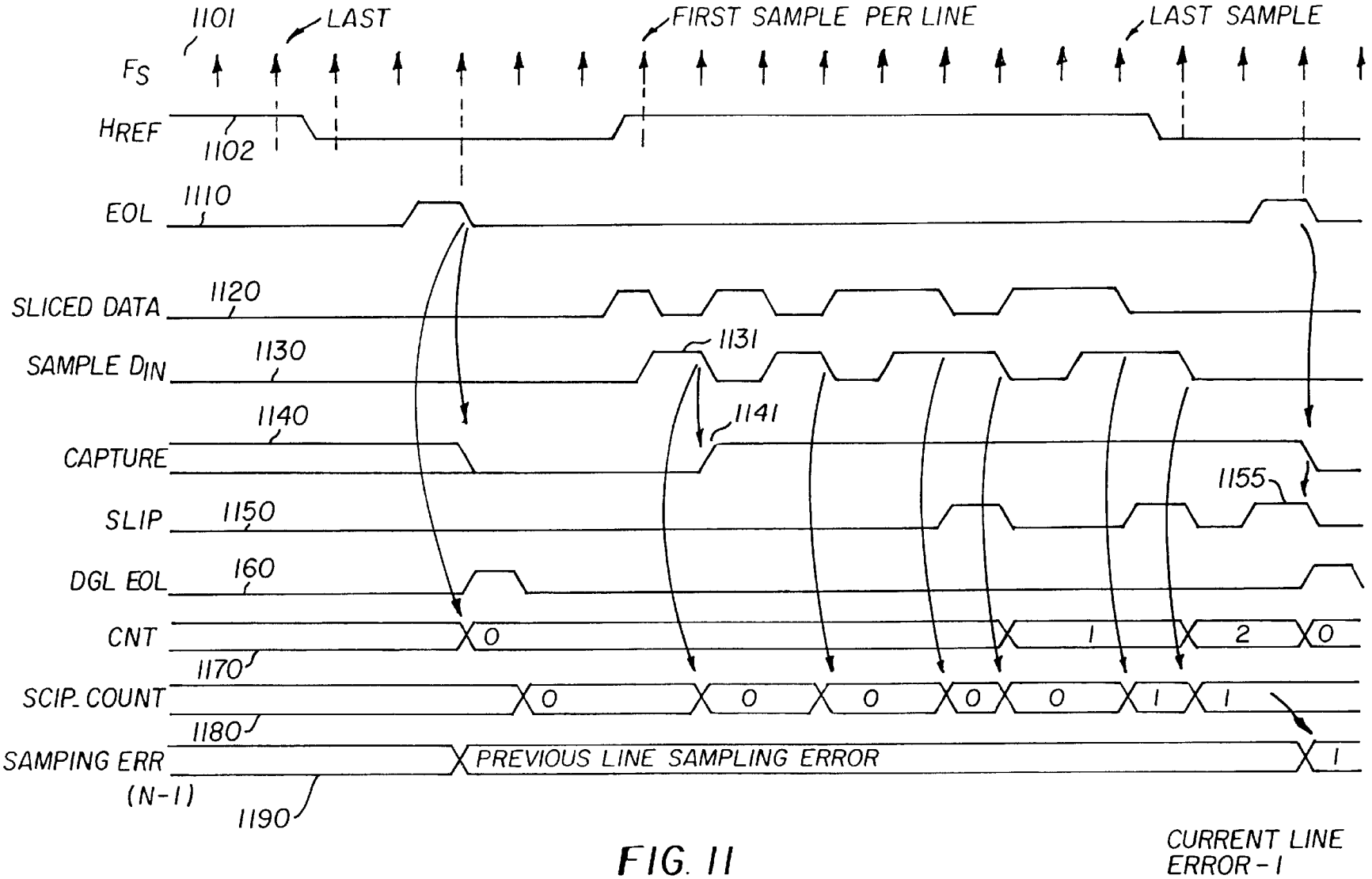
FIG. 11 is a timing diagram illustrating the relationship between various signals generated by the circuit of FIG. 10.

With reference to FIG. 11, the rising edges of sampling clock with present frequency $F_s$ are shown along time scale. A transition from a high logical value to a low logical value on HDISP signal indicates the end of display of a horizontal line in the SVGA environment as is well known in the art. HDISP signal can be generated from horizontal start and horizontal end positions in analog display signal frame. One scheme for determining horizontal start and horizontal end positions is explained in co-pending Patent Application entitled, "A Method and Apparatus for Automatically Determining Signal Parameters of an Analog Display Signal Received by a Display Unit of a Computer System", Ser. No.:UNASSIGNED, Filed Concurrently herewith, and having Attorney Docket Number: PRDS-0003.

Continuing with the description of an embodiment of sampling error measurement block 560 with combined reference to FIGS. 10 and 11, flip-flop 1011 and AND gate 1012 operate to generate a logical value of 1 a short time after a falling edge of HDISP signal. Flip-flops 1013 and 1014 cause the logical value of 1 to be delayed by one sampling clock cycle. The output of flip-flop 1014 is referred to as EOL (end-of-line) signal and is shown in FIG. 11 also. The EOL signal is shown going to a high logical state a clock cycle after HDISP signal goes low.

As to block 1002, comparator 120 receives a threshold value from a register, compares each sampled value received on Din line with the threshold value, and generates a logical high value as output (sliced-data) if the received sampled data value is greater than the threshold value. Assuming that the alternate pixels are encoded with all ones (white color) and zero (black color) values in alternate positions of a horizontal line, an average of zero and all ones can be chosen for the threshold value. Flip-flop 1030 delays the sliced data by a clock cycle. Signals representing the output of flip-flop 1030 (sampled-Din) and sliced data are shown in FIG. 11.

As to block 1003, the output of flip-flop 1040 corresponds to a previous sampled value. The previous sampled value and a present sampled value received on line 1135 are provided as inputs to XNOR gate 1150. XNOR gate 1150 generates a logical value of 1 as output if the two values are equal. Thus, if the same value is repeated during consecutive sampling clock cycles, XNOR 1150 generates a value of 1 as an output. The output of XNOR 1150 can be a 1 if a run is encountered while sampling the test data or while processing the samples corresponding to the retrace period (as all samples may be equal to zero).

Block 1004 blocks the logical values of 1 (in the output of XNOR 1050) from a time EOL high is received to the beginning of the active display portion which encodes the predetermined test pattern. The selection is accomplished by recognizing that the first pixel of each horizontal line is encoded with a 1 (white color) and the samples preceding the first pixel will have a value of 0.

Thus, S-R flip-flop 1070 generates a logical value of one (capture signal) only after a first sampled value greater than a predetermined threshold is received on a horizontal line. Capture signal 1140 is shown in FIG. 11. Capture signal 1140 is raised to a high logical state (shown at 1141) after a first 1 is received in sampled-Din line (shown at 1131). The capture signal 1140 remains at a high logical level until the EOL signal is received again. A transition to low logical level on EOL signal resets the flip-flop 1070.

When the capture signal 1140 is high, the output of XNOR 1050 is generated as output of AND gate 160. Thus, any run determinations by XNOR 1050 while processing the samples corresponding to the active display portion of the horizontal line are passed through AND 1060. The output of AND gate 160 (SLIP signal) is shown in FIG. 11.

However, during the period between the last pixel of the active display portion and the EOL high, the capture signal remains at a high logical level. As a result, logical value of 1 on slip signal is encountered during the period between the end of the active display portion and the time when EOL goes to a high logical value. An example is shown at 1155 in FIG. 11. As should be appreciated, 1155 should not count in run count as SLIP is not generated based on the test pattern encoded in the active display signal portion. Block 1006 in combination with register 190 ensures that 1155 is not counted in run count as will be explained below.

As to block 1005, binary counter 1080 counts the number of slip signals received from AND 1060. Counter 1080 is reset by EOL signal. The count in counter 1080 is loaded into register 1090 when line 1089 is at a logical level of one. Block 1006 controls line 1089 to ensure that values of 1 after the end of active display portion are not counted in the final run count.

As to block 1006, OR gate 1085 generates a logical value of 1 on the line 1089 when sampled-Din has a value of 1 or when the delayed EOL signal (shown as 1160 in FIG. 11) is received. Thus, the value in binary counter 1080 is transferred to register 1090 when a 1 value is generated as the sliced data (i.e., typically when the sampled value corresponds to 1 or white). During the period between the last pixel in the active display portion and the EOL, both sampled-Din and delayed EOL signal have a value of 0. Thus, any value counted by counter 1080 due to an output of 1 generated by AND 1060 between the last pixel of an active display and the EOL is not transferred to register 190.

The delayed EOL signal received from flip-flop 1072 causes zero value from counter 1080 to be transferred into register 1090. Holding register 1095 stores the slip-count during the entire next horizontal line for processing by micro-processor 180. The slip-count so provided is also referred to as run count for the processed horizontal display line. As can be noted from FIG. 10, the run count stored in holding register 1095 and register 1090 may actually be less by one that the correct run count if the last value of one in the active portion of the horizontal line causes a run/slip. However, a deviation by one may not be significant in the operation of the invention.

Based on the run count provided by holding register 1095, micro-controller 580 can vary the sampling frequency as described above to determine the original frequency (or harmonic thereof). The sampling frequency is varied if the samples corresponding to a test pattern (i.e., horizontal line) are not equal to the data values of the horizontal line. Once the run count is determined to be zero, micro-controller 580 determines that the sampling frequency equals the original frequency. Using the original frequency, display unit 270 can sample the subsequently received display signal frames accurately to reproduce the images encoded in the display signal frames.

In the description above, a test pattern has been described to include zeros and ones in alternate positions of a horizontal line. However, it should be understood that other predetermined sequence of bits can be employed without departing from the scope and spirit of the present invention. The sequence can be other cyclical data (e.g., a set of two ones followed by a zero repeated in a horizontal line) or acyclical. Both the graphics source and the display unit need to be implemented consistent with the convention chosen.

When the test pattern includes zeros and ones in alternate positions in an alternate line and RUN COUNT equals zero, the sampling frequency may equal the original frequency or a harmonic of the original frequency. To determine the original frequency accurately, test data with a different spatial frequency can be used. In one example embodiment, each line (in predetermined frames) is encoded with repetition of a set including two ones and a zero. However, the data can be acyclic as well, as will be explained below.

12. Alternative Embodiment in Which the Test Data can Include Arbitrary Bit Sequences In the description above, the bit sequences (encoded in each horizontal line) is predetermined and a separate frame 400 is sent to indicate the presence of a test pattern. However, the sequence of bits included in each test pattern can be arbitrary also explained below.

Thus, in one embodiment, each line (e.g., line 420 of FIG. 4) following the code 499 in FIG. 4 can be encoded with the same number of bits as the number of pixel data elements used to generate an analog signal for a horizontal line. For explanation purpose, it will be assumed that the number of bits is equal to 480. Of these 480 bits, 464 can include arbitrary bit values and the remaining 16 bits can define a horizontal line code. The horizontal line code can be computed similar to code 466. That is, the 16-bit code is computed such that a predetermined syndrome will be generated if all the 480 bits are processed by a CRC generator.

A CRC generator similar to that described in FIG. 6 can be implemented in the graphics unit to process the sampled values. However, the CRC generator here should be clocked by the sampling clock (instead of HSYNC) and the CLR signal should be coupled to the HSYNC clock (instead of VSYNC). The desired syndrome can be different for different lines. For example, the desired syndrome can be incremented for each horizontal line of the test pattern. This may provide additional level of security in ensuring that incorrect determinations of the presence of test pattern are not made in display unit 270.

One problem with this embodiment is that any deviation of the sampled values from the test data may not provide guidance on the degree of error or whether the sampling frequency should be increased or decreased. The display unit may simply need to change the frequency by trial ane error until an equality of detected. However, as the data encoded here can have any spatial frequency, the sampled values will not be found to be equal to the test data when the sampling frequency equals the harmonic frequency of the original frequency. Accordingly, this embodiment can be used in combination with the embodiment employing alternate zeros and ones to reliably determine the original frequency.

Thus, using one of several conventions, the test data may be encoded into an analog display signal and transferred to a digital display unit. The digital display unit determines the original frequency by examining the analog display signal. As the received display signal frames are sampled with the same frequency as the original frequency used by a graphics source, the sampled values are generally close to the pixel values using which the display signals are generated. In addition, display quality is affected less by jitter in the generated clock when compared to prior art systems which may not use the present invention.

13. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. In a computer system including a digital display unit which receives analog display signals generated by a graphics source and displays images encoded in the received analog display signals, wherein said graphics source generates said analog display signals from pixel data elements, said graphics source generating said analog display signals using an original frequency, a method of enabling said digital display unit to determine said original frequency, said method comprising the steps of:

(a) generating a sequence of test patterns according to a predetermined convention;

(b) encoding said sequence of test patterns in an analog display signal using said original frequency, said step of encoding being performed in said graphics source;

(c) sending said analog display signal encoded with said sequence of test patterns from said graphics source to said display unit;

(d) receiving in said display unit said analog display signal sent in step (c);

(e) sampling a portion of said received analog display signal using a sampling clock having a sampling frequency to generate a plurality of sampled values;

(f) determining whether said plurality of sampled values are equal to at least one of said sequence of test patterns based on said predetermined convention; and (g) changing the sampling frequency and performing steps (e) and (f) until said plurality of sampled values for a portion of said analog display signal are equal to one of said sequence of test patterns encoded in said analog display signal, wherein said original frequency equals said sampling frequency when said plurality of sampled values are equal to one of said sequence of test patterns.

2. The method of claim 1, wherein said predetermined convention comprises including a first color value and a second color value in alternate positions of each horizontal line of said analog display signal, and wherein each said sequence of test patterns includes one or more of said horizontal lines, and wherein step (g) comprises the step of:

(h) determining the number of runs in said plurality of sampled values for each horizontal line, wherein a run represents consecutive samples having the same sampled value.

3. The method of claim 2, wherein step (g) comprises the further steps of:

(i) increasing the sampling frequency by a small number and measuring the number of runs;

(j) determining that the sampling frequency needs to be further increased if the number of runs measured in step (i) is less than the number of run measured in step (f);

(k) determining that the sampling frequency needs to be decreased if the number of runs measured in step (i) is more than the number of run measured in step (f).

4. The method of claim 3, the sampling frequency is increased on decreased according to the number of runs determined in step (h).

5. The method of claim 2, wherein said first color values comprise ones and said second color values comprise zeros.

6. The method of claim 1, further comprising the step of providing an indication to the digital display unit that said analog display signal includes said sequence of test patterns.

7. The method of claim 1, wherein said predetermined convention comprises including any sequence of bits in a portion of said sequence of test patterns, and including a code value to enable said digital display unit to identify that said analog display signal includes said sequence of test patterns.

8. The method of claim 6, wherein said code value is generated by using a cyclic redundancy check (CRC) scheme.

9. A frequency measurement circuit for use in a digital display unit of a computer system, said digital display unit receiving analog display signals generated by a graphics source and displaying images encoded in the received analog display signals, wherein said graphics source generates said analog display signals from pixel data elements, said graphics source generating said analog display signals using an original frequency, said frequency measurement circuit determining said original frequency, said frequency measurement circuit comprising:

a clock generator for generating a sampling clock having a sampling frequency;

an analog to digital converter (ADC) coupled to said clock generator, said ADC receiving an analog display signal from said graphics source, wherein said analog display signal comprises display data or a sequence of test patterns, said sequence of test patterns being generated by said graphics source according to a predetermined convention, said ADC sampling said received analog display signal at said sampling frequency to generate a plurality of sampled values;

a sampling error measurement block for determining whether said plurality of sampled values are equal to one of said sequence of test patterns based on said predetermined convention; and a micro-controller coupled to said clock generator, said micro-controller controlling said clock generator to change the sampling frequency, wherein said ADC samples said analog display signal using changed sampling frequency, said micro-controller micro-controller changing said sampling frequency until said sampling error measurement block determines that said plurality of sampled values generated with a changed sampling frequency equal one of said sequence of test patterns according to said predetermined convention, wherein said original frequency equals said sampling frequency when said plurality of sampled values are equal to said sequence of test patterns.

10. The frequency measurement circuit of claim 9, wherein said predetermined convention comprises including a first color value and a second color value in alternate positions of each horizontal line of said analog display signal, each of said sequence of test patterns including one or more said horizontal lines, and wherein said sampling error measurement block is designed to determine the number of runs in said plurality of sampled values for each horizontal line, wherein a run represents consecutive samples having the same sampled value.

11. The frequency measurement circuit of claim 10, wherein said micro-controller is designed to decrease the sampling frequency by a small number if the number of runs is not equal to zero, said micro-controller determining that the sampling frequency needs to be further decreased if the number of runs decreases with the modified sampling frequency, said micro-controller determining that the sampling frequency needs to be increased if the number of runs increases with the decreased sampling frequency.

12. The frequency measurement circuit of claim 11, wherein said first color values comprise ones and said second color values comprise zeros.

13. The frequency measurement circuit of claim 9, wherein said predetermined convention comprises including any sequence of bits in one of said sequence of test patterns, and including a code value to enable said digital display unit to identify that said analog display signal includes said one of said sequence of test patterns.

14. The frequency measurement circuit of claim 13, wherein said code value is generated by using a cyclic redundancy check (CRC) scheme.

15. A computer system comprising:

a graphics source for generating an analog display signal including a plurality of frames, some of said plurality of frames encoding display data, wherein display data of a frame represents an image, said graphics source encoding a sequence of test patterns generated according to a predetermined convention in some of said plurality of frames, said graphics source generating said plurality of frames at an original frequency; and a digital display unit for receiving said analog display signal, said digital display unit including a display screen for displaying said images encoded in said plurality of frames, said digital display unit sampling said analog display signal to generate display signals to display said images on said display screen, said digital display unit determining said original frequency by examining said some of said plurality of test frames including said sequence of test patterns, wherein said digital display unit samples any of subsequently received frames comprised in said plurality of frames at a sampling frequency equal to said original frequency.

16. The computer system of claim 15, wherein said digital display unit comprises a frequency measurement circuit for determining said original frequency, said frequency measurement circuit comprising:

a clock generator for generating a sampling clock having said sampling frequency;

an analog to digital converter (ADC) coupled to said clock generator, said ADC receiving said analog display signal from said graphics source, wherein said analog display signal comprises display data or a sequence of test patterns, said sequence of test patterns being generated by said graphics source according to a predetermined convention, said ADC sampling said received analog display signal using said sampling frequency to generate a plurality of sampled values;

a sampling error measurement block for determining whether said plurality of sampled values are equal to said sequence of test patterns based on said predetermined convention; and a micro-controller coupled to said clock generator, said micro-controller controlling said clock generator to change the sampling frequency, wherein said ADC samples said analog display signal using said changed sampling frequency, said micro-controller micro-controller changing said sampling frequency until said sampling error measurement block determines that said plurality of sampled values generated with a changed sampling frequency equal at least one of said sequence of test patterns, wherein said original frequency equals said sampling frequency when said plurality of sampled values are equal to said sequence of test patterns.

17. The computer system of claim 16, wherein said predetermined convention comprises including a first color value and a second color value in alternate positions of each horizontal line of said analog display signal, each of said sequence of test patterns including one or more of said horizontal lines, and wherein said sampling error measurement block is designed to determine the number of runs in said plurality of sampled values for each horizontal line, wherein a run represents consecutive samples having the same sampled value.

18. The computer system of claim 17, wherein said micro-controller is designed to decrease the sampling frequency by a small number if the number of runs is not equal to zero, said micro-controller determining that the sampling frequency needs to be further decreased if the number of runs decreases with the modified sampling frequency, said micro-controller determining that the sampling frequency needs to be increased if the number of runs increases with the decreased sampling frequency.

19. The computer system of claim 18, wherein said first color values comprise ones and said second color values comprise zeros.

20. The computer system of claim 16, wherein said predetermined convention comprises including any sequence of bits in a portion of said sequence of test patterns, and including a code value to enable said digital display unit to identify that said analog display signal includes said sequence of test patterns.

21. The computer system of claim 20, wherein said code value is generated by using a cyclic redundancy check (CRC) scheme.

22. In a computer system including a digital display unit which receives analog display signals generated by a graphics source and displays images encoded in the received analog display signals, wherein said graphics source generates said analog display signals from pixel data elements, said graphics source generating said analog display signals using an original frequency, a frequency determination means for determining said original frequency in said digital display unit, said frequency determination means comprising:

means for generating a sequence of test patterns according to a predetermined convention;

means for encoding in said graphics source said sequence of test patterns in an analog display signal using said original frequency;

means for sending said analog display signal encoded with said sequence of test patterns from said graphics source to said display unit;

means receiving in said display unit said analog display signal;

means for sampling said received analog display signal using a sampling clock having a sampling frequency to generate a plurality of sampled values;

means for determining whether said plurality of sampled values are equal to one of said sequence of test patterns based on said predetermined convention; and means changing the sampling frequency until said plurality of sampled values are equal to a subsequently received one of said sequence of test patterns, wherein said original frequency equals said sampling frequency when said plurality of sampled values are equal to at one of said sequence of test patterns.

23. The method of claim 6, wherein analog signals encoding data representing images are sent from said graphics source on a communication path, and said step of providing an indication comprises the step of sending a code from said graphics source to said digital display unit on said communication path.

24. The method of claim 23, wherein said step of sending a code comprises the step of sending said code from said graphics source to said digital display unit during a time active display data is sent from said graphics source to said digital display unit.

25. The frequency measurement circuit of claim 13, wherein analog signals encoding data representing images are sent from said graphics source on a communication path, and said code value is sent from said graphics source to said digital display unit on said communication path.

26. The frequency measurement circuit of claim 25, wherein said code value is sent during a time active display data is sent from said graphics source to said digital display unit.

27. The computer system of claim 20, wherein analog signals encoding data representing images are sent from said graphics source on a communication path, and said code value is sent from said graphics source to said digital display unit on said communication path.

28. The computer system of claim 27, wherein said code value is sent during a time active display data is sent from said graphics source to said digital display unit.

29. The method of claim 1, wherein said predetermined convention enables step (f) to be performed without requiring prior storage of said sequence of test patterns in said digital display unit.

30. The frequency measurement circuit of claim 13, wherein said predetermined convention enables step (f) to be performed without requiring prior storage of said sequence of test patterns in said digital display unit.

31. The computer system of claim 20, wherein said predetermined convention enables step (f) to be performed without requiring prior storage of said sequence of test patterns in said digital display unit.

* * * * *